United States Patent [19]

Andres

[11] Patent Number: 4,825,826

[45] Date of Patent: May 2, 1989

[54] AUTOMATIC PRESTART OR POST SHUTOFF ENGINE LUBRICATOR

[75] Inventor: James R. Andres, Vandalia, Ohio

[73] Assignee: The United States of America as represented by the Secretary of the Air Force, Washington, D.C.

[21] Appl. No.: 187,143

[22] Filed: Apr. 28, 1988

[51] Int. Cl.[4] ..... F01M 1/00

[52] U.S. Cl. ..... 123/196 S; 184/6.3

[58] Field of Search ..... 123/196 R, 196 S; 184/6.3

[56] References Cited

U.S. PATENT DOCUMENTS

| | | | |
|---|---|---|---|
| 1,926,801 | 9/1933 | Christian | 123/196 R |
| 2,178,756 | 11/1939 | Joost | 123/196 R |
| 2,273,888 | 2/1942 | Paulsen | 123/196 R |
| 2,755,787 | 7/1956 | Butler et al. | 123/196 R |
| 2,867,203 | 1/1959 | Easton et al. | 123/196 R |
| 2,889,821 | 6/1959 | Maki | 123/196 R |
| 3,425,404 | 2/1969 | Lamkin | 123/196 R |
| 3,556,070 | 12/1971 | Holcomb | 123/196 R |
| 3,842,937 | 10/1974 | Lippay et al. | 123/196 R |
| 4,061,204 | 12/1977 | Kautz | 123/196 S |
| 4,112,910 | 9/1978 | Percy | 123/196 R |
| 4,168,693 | 9/1979 | Harrison | 123/196 S |
| 4,502,431 | 3/1985 | Lulich | 123/196 S |
| 4,513,704 | 4/1985 | Evans | 123/196 S |
| 4,524,734 | 6/1985 | Miller | 123/196 S |
| 4,703,727 | 11/1987 | Cannon | 123/196 S |

*Primary Examiner*—E. Rollins Cross

*Attorney, Agent, or Firm*—Bobby D. Scearce; Donald J. Singer

[57] ABSTRACT

A system for automatically injecting lubricating oil into the lubricating system of an engine prior to startup of the engine or following shutdown of the engine is described which comprises a solenoid controlled spring-loaded piston and cylinder arrangement which is filled with oil under pressure during normal engine operation and a control circuit responsive to the ignition switch of the engine for controlled or metered release of oil from the cylinder either just prior to engine startup or after engine shutdown.

8 Claims, 3 Drawing Sheets

AUTOMATIC PRESTART OR POST SHUTOFF ENGINE LUBRICATOR

RIGHTS OF THE INVENTION

The invention described herein may be manufactured and used by or for the Government of the United States for all governmental purposes without the payment of any royalty.

BACKGROUND OF THE INVENTION

The present invention relates generally to lubrication systems for internal combustion engines, and more particularly to a novel system for injecting lubricating oil to moving parts of an internal combustion engine prior to engine startup or after engine shutdown.

A substantial amount (some authorities estimate 70–80%) of wear in internal combustion engines occurs during engine startup before the oil pump begins providing adequate lubrication to the moving parts of the engine. Wear at startup is particularly pronounced in engines having significant periods of idle time between periods of active use during which idle time the engine cools off and the oil substantially drains off engine parts. Power carts for runway use around aircraft are representative of engines which may experience substantial idle periods between periods of intense use.

The general problem of engine wear at startup has been recognized and confronted by workers in the prior art, and numerous lubricating systems for solving this problem have been proposed. Representative of prior art lubricating systems for supplying oil to moving parts of an internal combustion engine prior to startup, such as upon switchon of the ignition, are represented by those disclosed in or referenced by U.S. Pat. No. 1,926,801 to Christian describing a system for pumping oil to the bearings of an internal combustion engine using a generator driven as a motor to turn an oil pump to force oil to the bearings when the ignition switch is turned on, afterward the generator-motor being reversed to act as a generator, which system does not pre-oil the bearings before the engine is cranked; U.S. Pat. No. 2,178,756 to Joost describing a lubricating system for an internal combustion engine to ensure preoiling before starting an engine by mechanical means blocking actuation of a first switch prior to actuation of a second switch; U.S. Pat. No. 2,273,888 to Paulsen describing an oil priming system for directing lubricant to the bearings of an engine at startup including a solenoid driven oil supply; U.S. Pat. No. 2,755,787 to Butler et al describing a preliminary lubricating device for an engine using an accumulator to supply oil as the starting system is energized and before the engine starts; U.S. Pat. No. 2,867,203 to Easton et al describing a pre-oiling device for an engine; U.S. Pat. No. 2,889,821 to Maki describing a manually operated system for providing heated oil to an engine at startup; U.S. Pat. No. 3,425,404 to Lamkin describing a pre-oiling device for engines including a reservoir with a solenoid driven diaphragm; U.S. Pat. No. 3,556,070 to Holcomb describing a lubricating system for energizing a solenoid and spring to open and close a valve in the oil line between an oil accumulator and the engine lubricating system; U.S. Pat. No. 3,842,937 to Lippay et al describing a manually operated pre-oiling system for an engine; and U.S. Pat. No. 4,112,910 to Percy describing a prelubrication system for an engine including a spring loaded piston.

The prior art systems suffer certain shortcomings which may include failure to inject oil to the lubrication system before the engine is cranked, or to allow sufficient time for a measured surge of oil to pass into the engine. Further, in some engine systems, such as internal combustion engine turbocharges, lubrication after engine shutdown may be highly desirable as a heat soak situation may exist after shutdown for which some fluid injected into the turbocharger both for cooling and lubrication may be desirable.

The invention solves or substantially reduces in critical importance problems with prior art systems by providing a system for automatically supplying oil to the bearings and moving parts of an engine just prior to engine startup in one embodiment, and just following engine shutdown in another embodiment. The system may be operatively connected to a lubrication pressure port of the engine and includes a solenoid controlled piston and cylinder arrangement which is filled with oil under pressure during normal engine operation and a control circuit for time delayed release of the oil from the cylinder just prior to engine startup or after engine shutdown. For prestart lubrication, pressurized oil in the cylinder is injected into the engine by a signal from the ignitions witch before the starter is engaged. For post shutdown lubrication, pressurized oil is released into the engine by preselected time delayed operation of the invention following shutoff of the ignition.

It is therefore a principal object of the invention to provide an improved lubricating system for an internal combustion engine.

It is another object of the invention to provide a lubricating system for an internal combustion engine wherein lubricating oil is automatically supplied to bearings and other moving parts inside the engine just prior to engine startup.

It is yet a further object of the invention to provide a lubricating system for an internal combustion engine wherein oil is supplied to the engine for a determinant time after engine shutdown.

These and other objects of the invention will become apparent as the detailed description of representative embodiments proceeds.

SUMMARY OF THE INVENTION

In accordance with the foregoing principles and objects of the invention, a system for automatically injecting lubricating oil into the lubricating system of an engine prior to startup of the engine or following shutdown of the engine is described which comprises a solenoid controlled spring-loaded piston and cylinder arrangement which is filled with oil under pressure during normal engine operation and a control circuit responsive to the ignition switch of the engine for controlled or metered release of oil from the cylinder either just prior to engine startup or after engine shutdown.

DESCRIPTION OF THE DRAWINGS

The invention will be clearly understood from the following detailed description of representative embodiments thereof read in conjunction with the accompanying drawings wherein.

DETAILED DESCRIPTION

Figure 1:
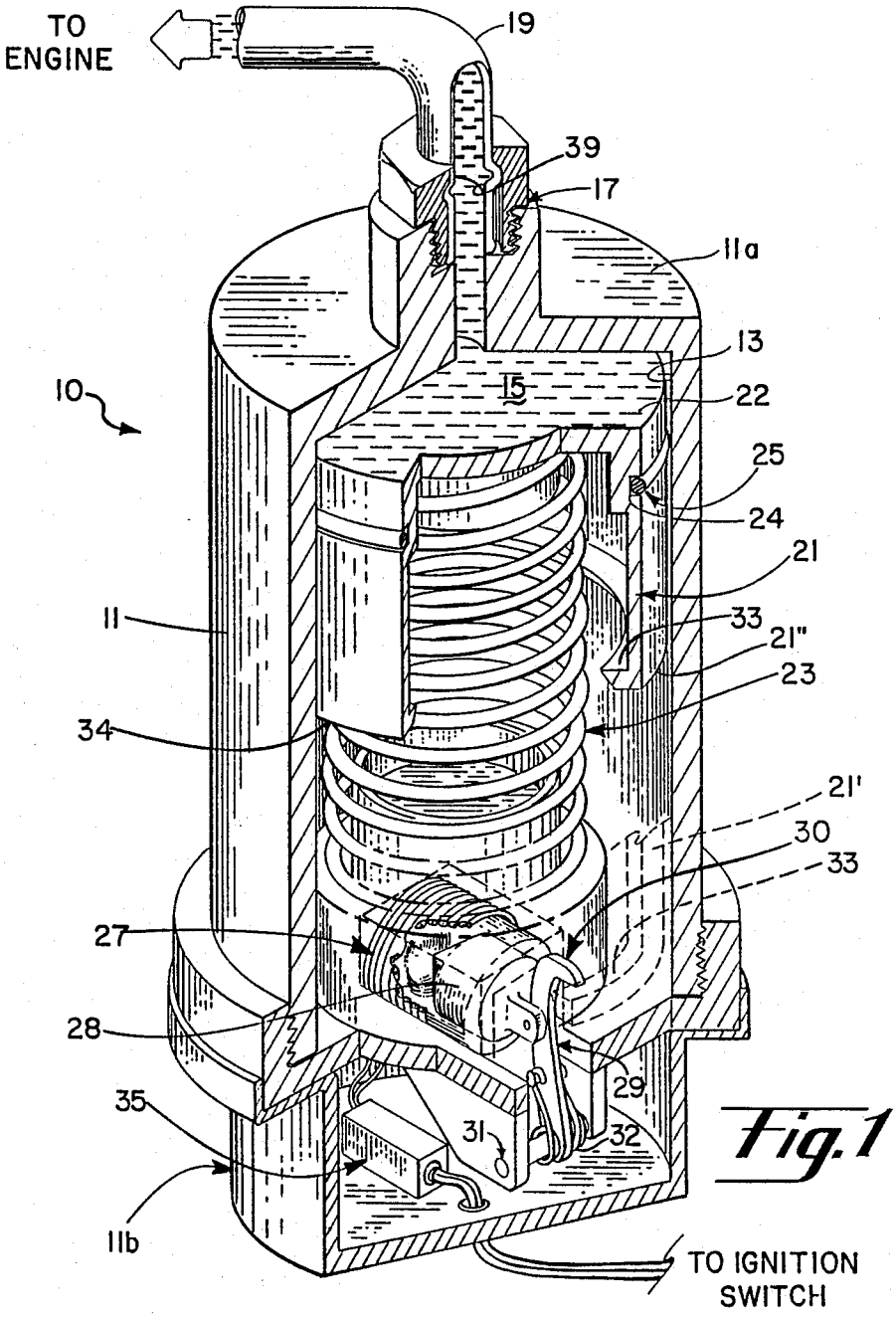
FIG. 1 is a view in axial section of a representative engine lubricator according to the invention.

Referring now to the drawings, shown in FIG. 1 in axial section is a representative embodiment of engine lubricator 10 of the invention. Lubricator 10 comprises a substantially cylindrical housing 11 defining internal chamber 13 of preselected compressible volumetric size for containing a desired quantity of lubricating fluid, vis., oil 15, for lubricating movable engine parts, bearings or other components prior to engine startup or following engine shutdown in accordance with the teachings of the invention. One substantially closed end 11a of housing 11 includes means defining inlet/outlet 17 communicating with chamber 13 for conducting oil 15 into and out of housing 11 in the operation of lubricator 10 as taught herein. Conduit 19 interconnects inlet/-outlet 17 with an engine (not shown) for which prestart or post shutdown lubricatin is desired. Conduit 19 may be operatively connected to the engine at any convenient location at which oil 15 may be inserted and withdrawn, such as the oil pressure transmitter port of the engine.

Piston 21 is slidably disposed within housing 11 and movable between first position 21′ (shown fragmentarily in phantom) and second position 21″. Axially compressible resilient spring 23 biases piston 21 toward position 21″. Chamber 13 is defined therefore between first end 22 of piston 21 and the internal surfaces of housing 11 and is of variable volume depending on the axial position of piston 21 within housing 11. Piston 21 further includes a sliding seal with the internal wall of housing 11 such as annular groove 24 containing O-ring seal 25 for sealing against oil leakage around piston 21.

An electrically controlled solenoid 27 is disposed at a second end of housing 11 with plunger 28 thereof operatively connected to spring loaded latching mechanism 29. Latch 30 of latching mechanism 29 is pivotally mounted to housing 11 at pivot 31 and resiliently mounted as with hairpin spring 32 to engage flange 33 on second end 34 of piston 21 at position 21′ shown in phantom. Solenoid 27 is electrically connected to the ignition switch (FIG. 1*a*) through a thermally activated time delay switch 35. A protective cover 11b attached conventionally to housing 11 may enclose and protect switch 35 and exposed parts of latching mechanism 29 and solenoid 27.

Figure 1A:
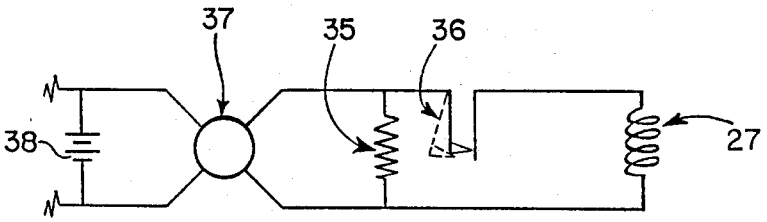
FIG. 1*a* is a representative power circuit for the lubricator of FIG. 1 showing connection to the ignition and battery of the engine.

Referring now additionally to FIG. 1*a*, shown therein is a simplified wiring schematic for switch 35, solenoid 27, ignition switch 37 and battery 38 of the engine. It is understood that other circuits may be used as would occur to the skilled artisan, the FIG. 1*a* circuit being only representative of such circuits.

Consider now an engine prestart condition wherein piston 21 is in the fully retracted and latched position 21′ and wherein chamber 13 is filled with oil 15 by reason of previous engine operation as described below. Activating ignition switch 37 to the first position thereof prior to engine start energizes solenoid 27 through the normally closed contacts 36 of thermal switch 35 and also initiates time delayed operation of thermal switch 35. This results in the immediate movement of plunger 28 which retracts latch 30 and releases piston 21 to move under the influence of spring 23 from position 21′ to position 21″ and thereby force oil 15 through conduit 19 to the engine lubricating system. Further turning of ignition switch 37 to the engine start position activates the engine starter for starting the engine. Subsequent operation of the engine generates sufficient oil pressure within lubricator 10 to refill chamber 13 and to return piston 21 to position 21′. After a preselected time delay characteristic of thermal switch 35 selected for inclusion in the lubricator structure of the invention, contracts 36 of thermal switch 35 open thereby deactivating solenoid 27 and allowing latch 30 to move into a position which holds piston 21 in position 21′ ready for the next engine start cycle. Resiliency of spring 23 may therefore be selected consistent with the oil pressure maintained during engine operation. In certain applications, it may be desirable to include in the structure of inlet/outlet 17 a metering orifice 39 to controllably restrict the flow rate of oil 15 through conduit 19.

Figure 2:
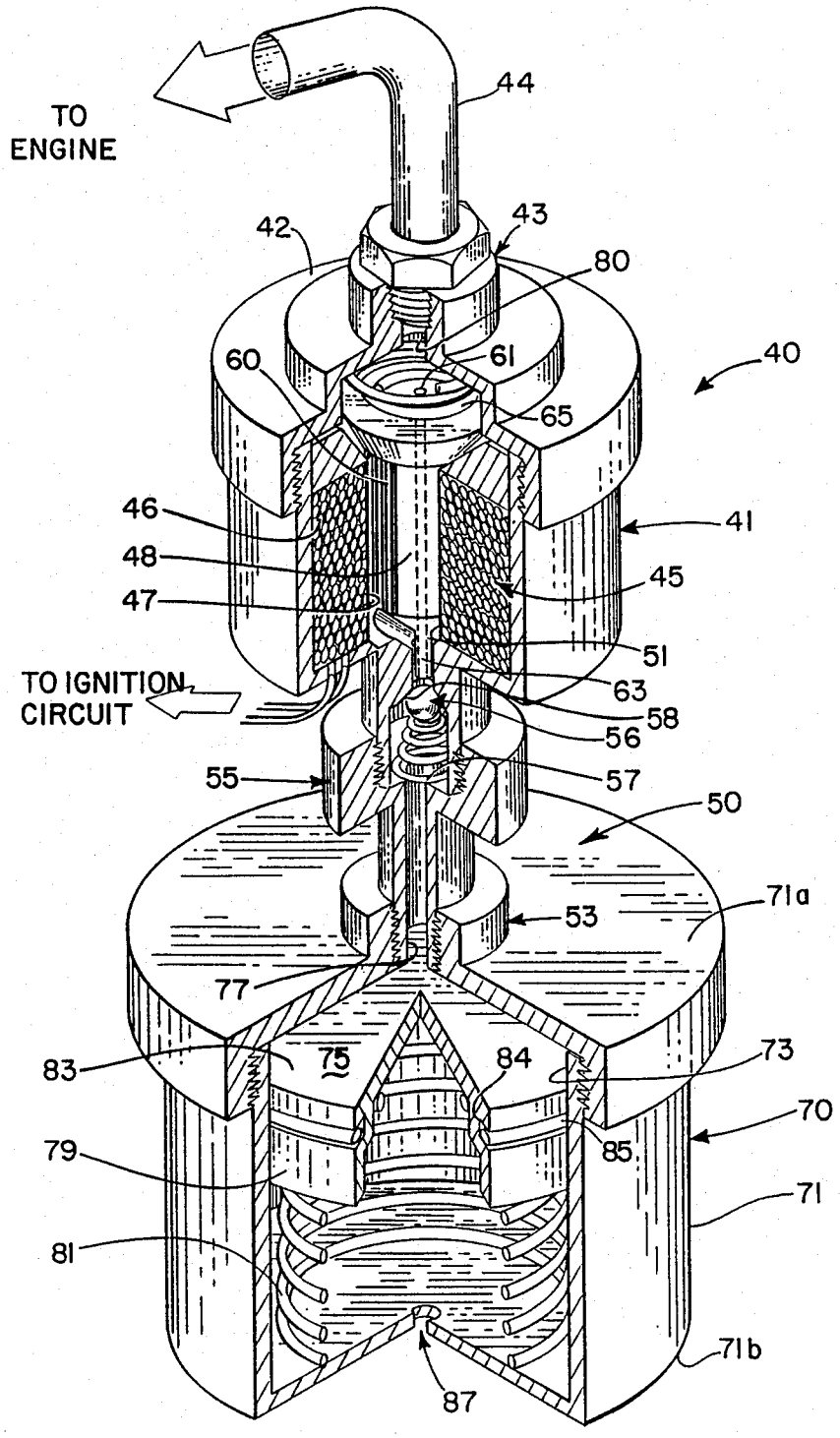
FIG. 2 is a view in axial section of an alternative embodiment of the invention.

Referring now to FIG. 2, shown therein in axial section is an alternative embodiment of the invention wherein an oil pressure accumulator is included to provide a separate reservoir of oil for lubricating engine parts. In FIG. 2, lubricator 40 comprises first housing portion 41 having means defining first inlet/outlet 43 at first end 42 therefor for operative connection to the lubricating system of an engine (not shown) through conduit 44 in manner comparable to conduit 19 of the FIG. 1 embodiment. Housing portion 41 encloses solenoid 45 including coil 46 defining an axial passageway 47 through housing portion 41, and having axially movable plunger 48 disposed within coil 46 substantially as shown. Plunger 48 is axially movable between open and closed positions in response to the application of electrical energy to coil 46.

The second end 50 of housing portion 41 includes means defining intermediate passageway 51 and inlet/-outlet 53. Interposed between inlet/outlet 53 and intermediate passageway 51 is a check valve 55 for selectively closing intermediate passageway 51. Check valve 55 may be of any suitable construction for the purpose contemplated herein, such as shown in FIG. 2 as including ball 56 biased by compression spring 57 against suitable machined (e.g., conical) surface 58 defining one (lower) end of intermediate passageway 51.

Plunger 48 may take any suitable shape consistent with the operation thereof contemplated herein. In the configuration of FIG. 2 plunger 48 has on the external surface thereof one or more flutes 60 and/or has one or more axially extending drilled passageways 61 for promoting flow through passageway 47 of oil in the operation of lubricator 40 as more fully explained below. One end (lower end in FIG. 2) of plunger 48 includes means for opening check valve 55 in response to movement of plunger 48 under the influence of coil 46. In the FIG. 2 embodiment, a tubular extension member 63 is formed on the end of plunger 48 and is sized to extend axially through intermediate passageway 51 and into contact with ball 56 of check valve 55. Plunger 48, extension member 63 and intermediate passageway 51 are sized so that compression spring 57 holds plunger 48 in a first position wherein check valve 55 is closed with no power to solenoid 45, and wherein energizing solenoid 45 results in movement of plunger 48 against check valve 55 so as to selectively promote flow through intermediate passageway 51. Tubular extension member 63 may further include flutes thereon and/or passageways therethrough for facilitating flow through passageways 51 and 47 when solenoid 45 is activated. Plunger 48 may be held in the desired axial position relative to coil 46 substantially as shown in FIG. 2 by suitable internal configuration for first end 42 of housing portion 41, and, further by the inclusion of a weak positioning coil spring 65 disposed between housing portion 41 and the corresponding end of plunger 48 to prevent rattling of plunger 48 within coil 46.

At inlet/outlet 53 is disposed separate reservoir 70 for containing oil in the operation of the FIG. 2 embodiment. Reservoir 70 comprises a substantially cylindrical housing portion 71 defining a compressible internal chamber 73 for containing a preselected quantity of oil 75 similarly to the FIG. 1 embodiment described above. Substantially closed end 71a includes means defining inlet/outlet 77 communicating with inlet/outlet 53 of housing portion 41 for conducting oil 75 into and out of housing portion 71 and through housing portion 41 to the engine in the operation of lubricator 70 in manner similar to that of lubricator 10 of FIG. 1. Piston 79 is slideably disposed within housing portion 71, is movable axially and is biased toward end 71a of housing portion 71 under the influence of axially compressible resilient coil spring 81 substantially to the position illustrated in FIG. 2. Under the pressure of oil 75 entering chamber 73 in the operation of lubricator 70, piston 79 is movable to a second position (not shown) near substantially closed second end **71*b* of housing portion 71 where coil spring 81 is compressed and chamber 73, defined between surface 83 of piston 79 and end 71*a* of housing portion 71, is expanded to maximum. In manner corresponding to the FIG. 1 structure, piston 79 includes a sliding seal with the internal wall surface of housing portion 71 such as at annular groove 84 containing O-ring seal 85 for sealing against oil leakage around piston 79. Air bleed hole 87 may be provided in end 71*b* of housing portion 71. As with the FIG. 1 embodiment, it may be desirable to include in the structure of inlet/outlet 43 a metering orifice 80 to controllably restrict the flow rate of oil 75 through conduit 44**.

Lubricator 70 of FIG. 2 may be controlled by the circuit shown in FIG. 1a in manner corresponding to operation described above for lubricator 10 of the FIG. 1 embodiment. It is noted that a time delay thermal switch corresponding to that shown in FIG. 1 may be included in the FIG. 2 embodiment although not specifically illustrated therein. Accordingly, consider that for purposes of discussion that solenoid 45 of FIG. 2 replaces solenoid 27 of FIG. **1*a*. In manner corresponding to operation of the FIG. 1 embodiment, consider an engine prestart condition for lubricator 70 wherein chamber 73 is full of oil 75 under engine oil pressure resulting from previous engine operation. Coil 46 of solenoid 45 is de-energized and plunger 48 is held in a displaced position relative to coil 46 by the resiliency of compression spring 57. Check valve 55 is therefore closed and oil 75 is held within expanded chamber 73 under pressure of coil spring 81 acting on piston 79. Activating ignition switch 37 prior to engine start energizes solenoid 45 which retracts plunger 48 against ball 56 which opens passageway 51 for flow of oil 75 through housing portion 41 to the engine. This action also initiates the time delayed operation of thermal switch 35 which after a preselected time deactivates solenoid 45 so that plunger 48 returns to the position occupied prior to engine start. Subsequent engine operation generates sufficient oil pressure to force open valve 55 so that chamber 73 is filled with oil 75 ready for the next engine start cycle. The resiliency of spring 57 is selected to have proper restoring force against plunger 48 and spring 81** is selected to provide the desired oil injection pressure consistent with the normal engine operation oil pressure.

Figure 3:
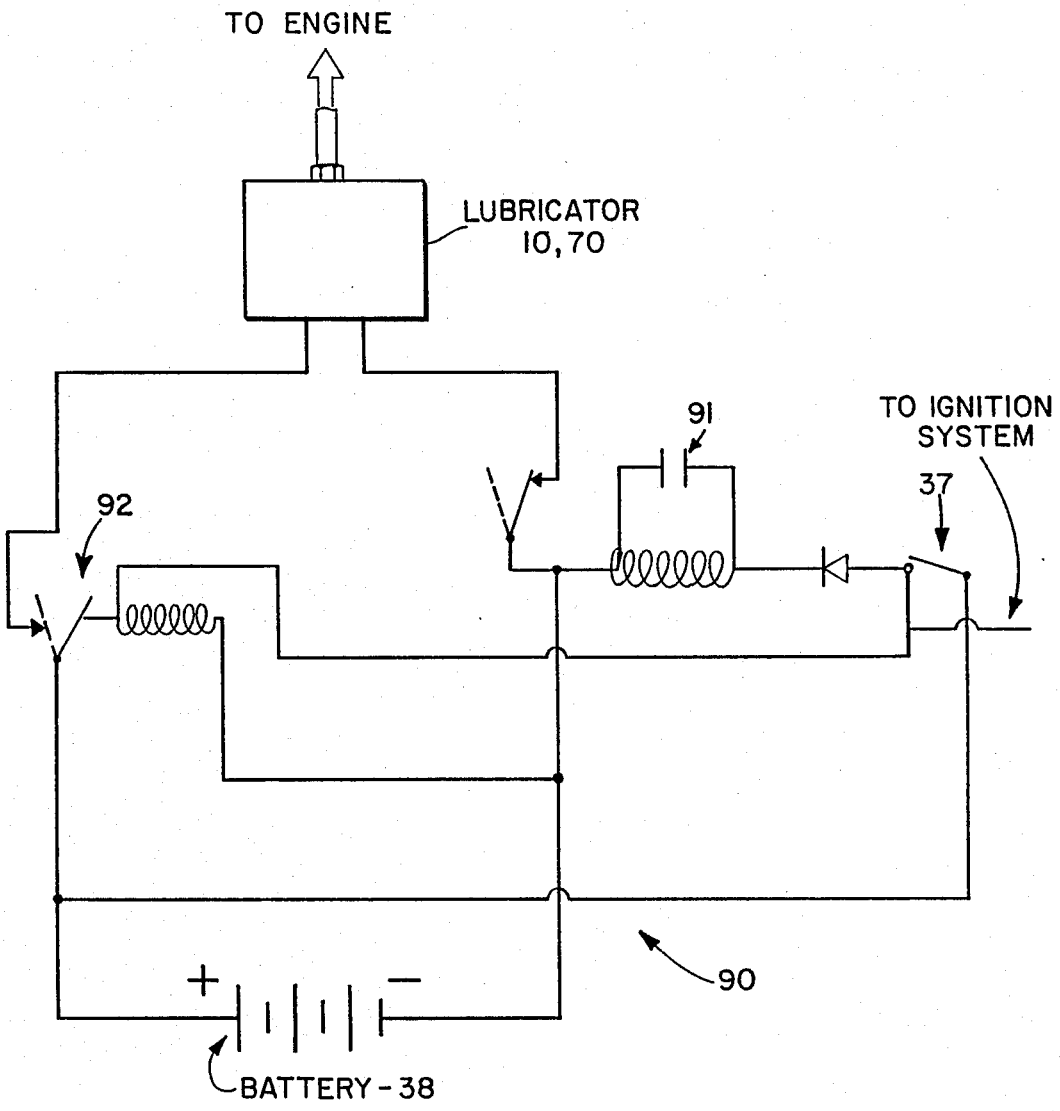
FIG. 3 is a representative power circuit useful in activating the lubricator following shutdown of the engine.

In some applications it may be desirable to provide the engine with a measured surge of oil upon engine shutdown instead of just prior to engine start. For example, in internal combustion engine turbochargers, it is important to maintain lubrication for a period of time after the engine is shut down because of the coastdown characteristics of the turbocharger. Post shutdown lubrication may also be desirable for engines in which the crankcase oil runs hot or in which there is otherwise a heat soak situation after shutdown and it is desirable to supply some lubricant for cooling as well as for lubrication. Either of the FIG. 1 or FIG. 2 embodiments may be used for post engine shutdown lubrication. Referring now to FIG. 3, shown therein is a diagram of a representative circuit useful in energizing the lubricator following engine shutdown. Circuit 90 shown in FIG. 3 comprises a first (normally open) time delay relay 91 and a second (normally closed) relay 92 operatively connected across the solenoid release mechanism of lubricator 10 or 70. When ignition switch 37 for the engine is closed, both relays 91,92 are energized and no power is supplied to the solenoids of the lubricator since relay 92 remains open so that chamber 13 or 73 of lubricator 10 or 70 may be filled during engine operation. When engine ignition is turned off, relay 92 closes while the (normally open) relay 91 remains closed which completes a circuit to and activates the lubricator for injecting oil into the engine. After the time delay characteristic of relay 91, it opens and power to the lubricator is cut off. The lubricator is recharged upon restart of the engine.

The amount of time delay selected for a particular embodiment of the invention depends on the release mechanism (e.g., latch or solenoid valve) selected for inclusion in the structure. If a latch is included (FIG. 1), only momentary application of power is required and the time delay may be short. If a solenoid valve is used (FIG. 2), a longer period of time (a few seconds) may be necessary to hold the valve open a sufficient length of time to release the oil. The time delay is a function of the relay coil impedance and the capacitance of the circuit (FIG. 3).

The invention therefore provides a novel automatic prestart or post shutdown engine lubricating system for internal combustion engines. It is understood that modifications to the invention as described may be made as might occur to one with skill in the field of the invention within the scope of the appended claims. All embodiments contemplated hereunder which accomplish the objects of the invention have therefore not been shown in complete detail. Other embodiments may be developed without departing from the spirit of the invention or from the scope of the appended claims.

I claim:

1. A system for injecting lubricating oil into an engine prior to startup of the engine, comprising:

(a) a substantially cylindrical housing having means defining an inlet at a first end thereof, said housing defining an interior chamber of preselected variable volumetric size for containing a quantity of lubricating oil;

(b) conduit means for operatively interconnecting said inlet with the engine;

(c) a piston slideably disposed within said housing and including a surface thereon further defining said interior chamber;

(d) spring means interposed between said piston and the second end of said housing and biasing said piston toward a first axial position near said first end of said housing;

(e) latch means for selectively holding said piston in a second position near said second end of said housing;

(f) a solenoid having the plunger thereof operatively connected to said latch means for selectively releasing said latch means;

(g) electrical means for operatively interconnecting said solenoid and the ignition switch of said engine for selectively energizing said solenoid in response to operation of said ignition switch; and (h) a time delay switching means operatively interconnecting said solenoid and said electrical means for selectively delaying the energizing of said solenoid in response to operation of said ignition switch.

2. The system as recited in claim 1 wherein said time delay switching means includes a thermal delay switch.

3. The system for injecting lubricating oil into an engine prior to startup of the engine, comprising:

(a) a first housing portion having means defining an inlet at a first end thereof and an outlet at a second end thereof;

(b) a solenoid including a coil and plunger disposed within said first housing portion and defining a central passageway through said coil from said inlet to said outlet, said plunger disposed for axial movement within said passageway between an extended position and a retracted position in response to energization of said coil of said solenoid;

(c) conduit means for operatively interconnecting said inlet of said first housing portion with the crankcase of the engine;

(d) a spring loaded check valve disposed at the outlet of said first housing portion, said check valve having a closed position and an open position;

(e) means on said plunger for engaging said check valve whereby said check valve is moved between said closed position and said open position in response to movement of said plunger;

(f) a substantially cylindrical second housing portion having means defining an inlet at a first end thereof, said second housing portion defining an interior chamber of preselected variable volumetric size for containing a quantity of lubricating oil;

(g) a piston slideably disposed within said second housing portion and including a surface thereon further defining said interior chamber;

(h) spring means interposed between said piston and the second end of said second housing portion and biasing said piston toward a first axial position near said first end of said second housing portion;

(i) electrical means for operatively interconnecting said solenoid and the ignition switch of said engine for selectively energizing said solenoid in response to operation of said ignition switch; and (j) a time delay switching means operatively interconnecting said solenoid and said electrical means for selectively delaying the energizing of said solenoid in response to operation of said ignition switch.

4. The system as recited in claim 3 wherein said time delay switching means includes a thermal delay switch.

5. A system for injecting lubricating oil into an engine following shutdown of the engine, comprising:

(a) a substantially cylindrical housing having means defining an inlet at a first end thereof, said housing defining an interior chamber of preselected variable volumetric size for containing a quantity of lubricating oil;

(b) conduit means for operatively interconnecting said inlet with the engine;

(c) a piston slidably disposed within said housing and including a surface thereon further defining said interior chamber;

(d) spring means interposed between said piston and the second end of said housing and biasing said piston toward a first axial position near said first end of said housing;

(e) latch means for selectively holding said piston in a second position near said second end of said housing;

(f) a solenoid having the plunger thereof operatively connected to said latch means for selectively releasing said latch means;

(g) electrical means for operatively interconnecting said solenoid and the ignition switch of said engine for selectively energizing said solenoid in response to operation of said ignition switch; and (h) a control circuit operatively interconnecting said solenoid and said electrical means and including a normally open time delay switching means and a normally closed electrical relay for selectively delaying the energizing of said solenoid in response to switchoff of said ignition switch upon shutdown of said engine.

6. The system as recited in claim 5 wherein said time delay switching means includes a thermal delay switch.

7. A system for injecting lubricating oil into an engine following shutdown of the engine, comprising:

(a) a first housing portion having means defining an inlet at a first end thereof and an outlet at a second end thereof;

(b) a solenoid including a coil and plunger disposed within said first housing portion and defining a central passageway through said coil from said inlet to said outlet, said plunger disposed for axial movement within said passageway between an extended position and a retracted position in response to energization of said coil of said solenoid;

(c) conduit means for operatively interconnecting said inlet of said first housing portion with the crankcase of the engine;

(d) a spring loaded check valve disposed at the outlet of said first housing portion, said check valve having a closed position and an open position;

(e) means on said plunger for engaging said check valve whereby said check valve is moved between said closed position and said open position in response to movement of said plunger;

(f) a substantially cylindrical second housing portion having means defining an inlet at a first end thereof, said second housing portion defining an interior chamber of preselected variable volumetric size for containing a quantity of lubricating oil;

(g) a piston slideably disposed within said second housing portion and including a surface thereof further defining said interior chamber;

(h) spring means interposed between said piston and the second end of said second housing portion and biasing said piston toward a first axial position near said first end of said second housing portion;

(i) electrical means for operatively interconnecting said solenoid and the ignition switch of said engine for selectively energizing said solenoid in response to operation of said ignition switch; and (j) a control circuit operatively interconnecting said solenoid and said electrical means and including a normally open time delay switching means and a normally closed electrical relay for selectively delaying the energizing of said solenoid in response to switchoff of said ignition switch upon shutdown of said engine.

8. The system as recited in claim 7 wherein said time delay switching means includes a thermal delay switch.

* * * * *

UNITED STATES PATENT AND TRADEMARK OFFICE

CERTIFICATE OF CORRECTION

PATENT NO. : 4,825,826

DATED : May 2, 1989

INVENTOR(S) : James R. Andres

It is certified that error appears in the above-identified patent and that said Letters Patent is hereby corrected as shown below:

On the COVER PAGE, delete "Assignee: The United States of America as represented by the Secretary of the Air Force, Washington, D.C."
Col 1, line 5, "RIGHTS OF THE INVENTION" should be ---RIGHTS OF THE GOVERNMENT---.
Col 1, line 46, "preoiling" should be ---pre-oiling---.
Col 2, line 8, "turbocharges" should be ---turbochargers---.
Col 2, line 27, "ignitions witch" should be ---ignition switch---.
Col 3, line 17, "vis." should be ---viz.---.
Col 3, line 24, the hyphen (-) should be deleted.
Col 3, line 26, "lubricatin" should be ---lubrication---.
Col 3, line 31, "slidably" should be ---slideably---.
Col 4, line 13, "contracts" should be ---contacts---.
Col 4, line 29, "therefor" should be ---thereof---.
Col 4, line 40, the hyphen (-) should be deleted.
Col 8, line 14, in claim 5, subparagraph (c), "slidably" should be ---slideably---.

Signed and Sealed this

Seventh Day of August, 1990

*Attest:*

HARRY F. MANBECK, JR.

*Attesting Officer*

*Commissioner of Patents and Trademarks*